US006725785B2

(12) United States Patent
Wang

(10) Patent No.: US 6,725,785 B2
(45) Date of Patent: Apr. 27, 2004

(54) PROTECTIVE COVER OF GRILLE-SHAPED ARTICLE SUPPORT

(75) Inventor: Tin-Chou Wang, Tainan Hsien (TW)

(73) Assignee: Hwan Yih Enterprise Co., Ltd., Taipei Hsien (TW)

( * ) Notice: Subject to any disclaimer, the term of this patent is extended or adjusted under 35 U.S.C. 154(b) by 56 days.

(21) Appl. No.: 10/189,016

(22) Filed: Jul. 5, 2002

(65) Prior Publication Data

US 2004/0003763 A1 Jan. 8, 2004

(51) Int. Cl.[7] ..... A47B 13/08
(52) U.S. Cl. ..... 108/90
(58) Field of Search ..... 108/90; 211/153, 211/162, 135

(56) References Cited

U.S. PATENT DOCUMENTS 4,679,818 A * 7/1987 Kakavas ..... 108/90
5,228,581 A * 7/1993 Palladino et al. ..... 211/153
5,538,147 A * 7/1996 Fucci ..... 211/153
5,697,302 A * 12/1997 Putnam ..... 108/90
5,992,331 A * 11/1999 Inoue et al. ..... 108/90
6,401,945 B1 * 6/2002 Gawel ..... 211/153

FOREIGN PATENT DOCUMENTS

WO WO93/14673 * 1/1993

* cited by examiner

*Primary Examiner*—Jose V. Chen
(74) *Attorney, Agent, or Firm*—Rosenberg, Klein & Lee

(57) ABSTRACT

A protective cover of a grille-shaped article support includes a flat portion for holding articles on, and a surrounding wall joined to edges of the flat portion. Clipping elements are provided on bottom side of the flat portion, and hooking elements are provided on inner side of the wall. The cover is firmly fitted over the article support with the clipping elements clipping onto corresponding metal bars of the article support, and with the hooking elements hooking onto edges of the article support so that articles can be stably held on the article support.

2 Claims, 3 Drawing Sheets

PROTECTIVE COVER OF GRILLE-SHAPED ARTICLE SUPPORT

BACKGROUND OF THE INVENTION

1. Field of the Invention

The present invention relates to a protective cover of grille-shaped article support, and more particularly to a protective cover, which helps articles to be held on the present article support stably, and which adds to the attractiveness of the article support.

2. Brief Description of the Prior Art

Grille-shaped article support consists of a frame, metal bars arranged across the frame, and legs connected to corners of the frame so that articles can be placed on the metal bars. Advantages of such article support are that it can be dismantled for easy storage, and that the user can adjust the metal bars to desired distance according to her needs. Such article support is also attractive owing to the metal bars. However, articles placed on such support are prone to tilt and fall down because of the spaces between the metal bars, causing the users inconvenience.

To overcome the above disadvantage, a pad is disposed on the metal bars before articles are placed on the same; thus, the articles won't abut the spaces between the metal bars. However, articles places on the pad are prone to move because the pad is not secured to the metal bars or the frame. In addition, when heavy articles are placed on the pad, edges of the pad are likely to be raised, and formed with wrinkles, affecting the appearance of the article support for the worse.

SUMMARY OF THE INVENTION

It is a main object of the present invention to provide a protective cover to a grille-shaped article support so that articles can be stably held on the article support.

It is another object of the present invention to provide a protective cover to a grille-shaped article support that can add to attractiveness of the article support.

The protective cover of the present invention includes a flat portion for holding articles on, and a surrounding wall joined to edges of the flat portion. Clipping elements are provided on bottom side of the flat portion, and hooking elements are provided on inner side of the wall. The cover is firmly fitted over the article support with the clipping elements clipping onto corresponding metal bars of the article support, and with the hooking elements hooking onto the frame of the article support.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
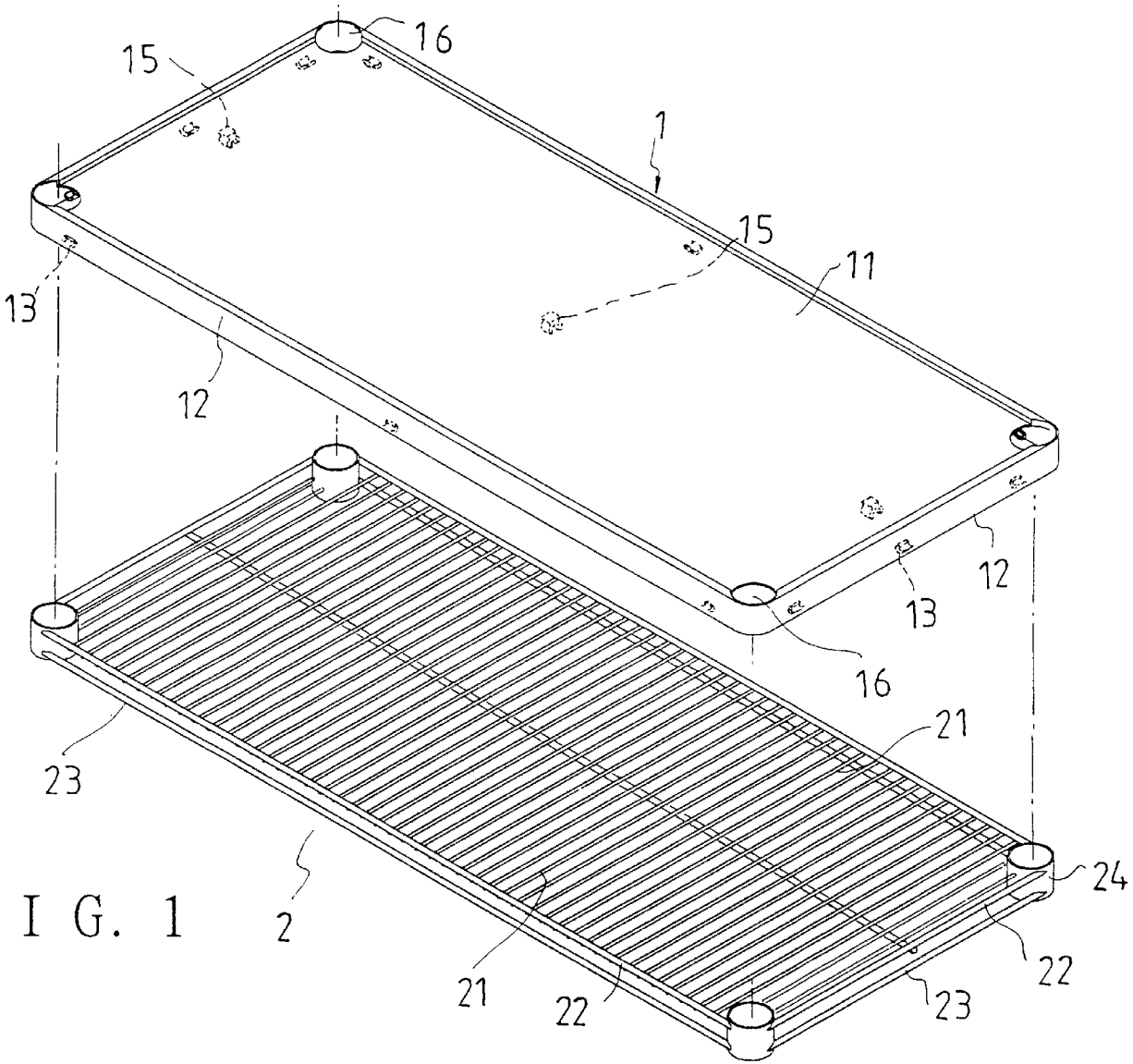
FIG. 1 is a perspective view of the article support and the cover according to the present invention.
Figure 3:
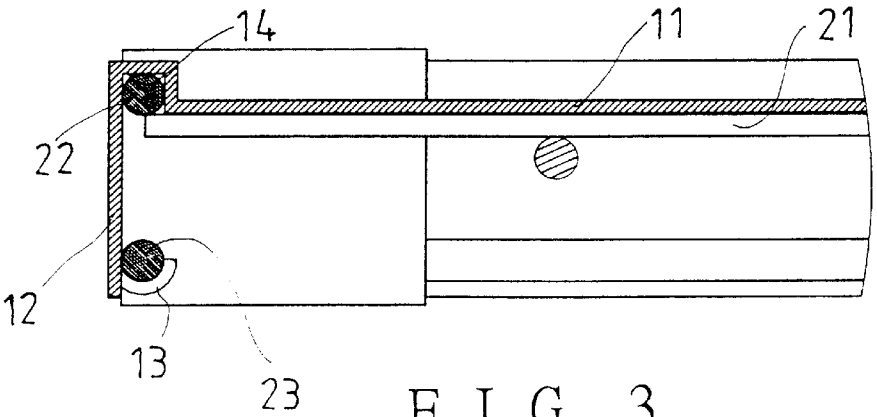
FIG. 3 is a partial cross-sectional view of the protective cover of the present invention joined to an article support; and, FIG. 4 is another partial cross-sectional view of the protective cover of the present invention joined to an article support.
Figure 4:
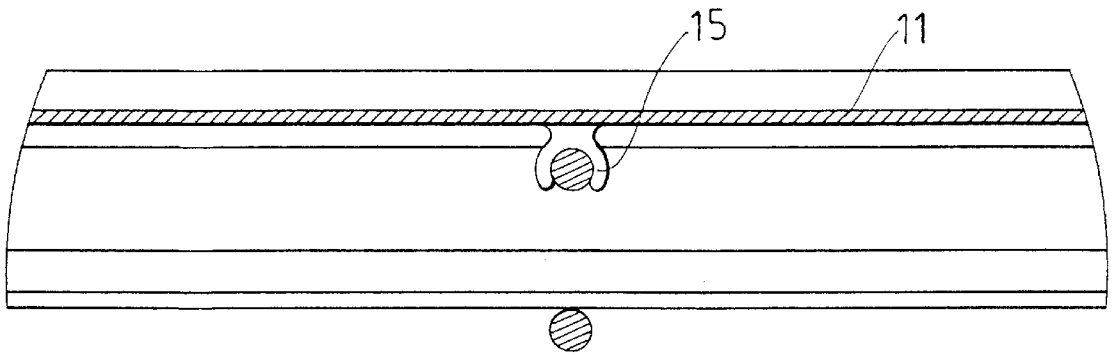

Referring to FIGS. 1, 3 and 4, a protective cover 1 of a grille-shaped article support according to the present invention includes a flat portion 11, and a surrounding wall 12. The cover 1 is made of plastic.

The flat portion 11 is provided for holding articles on. The flat portion 11 has several clipping elements 15 on a bottom side thereof, folded engaging portions 14 on edges, and through holes 16 on corners thereof. The surrounding wall 12 is joined to the edges of the flat portion 11. The surrounding wall 12 has several hooking elements 13 on an inner side thereof.

A grille-shaped article support 2 has a frame consisting of upper metal rods 22 and lower metal rods 23; metal bars 21 are arranged across the frame, and connecting tubes 24 are disposed on corners of the frame.

Figure 2:
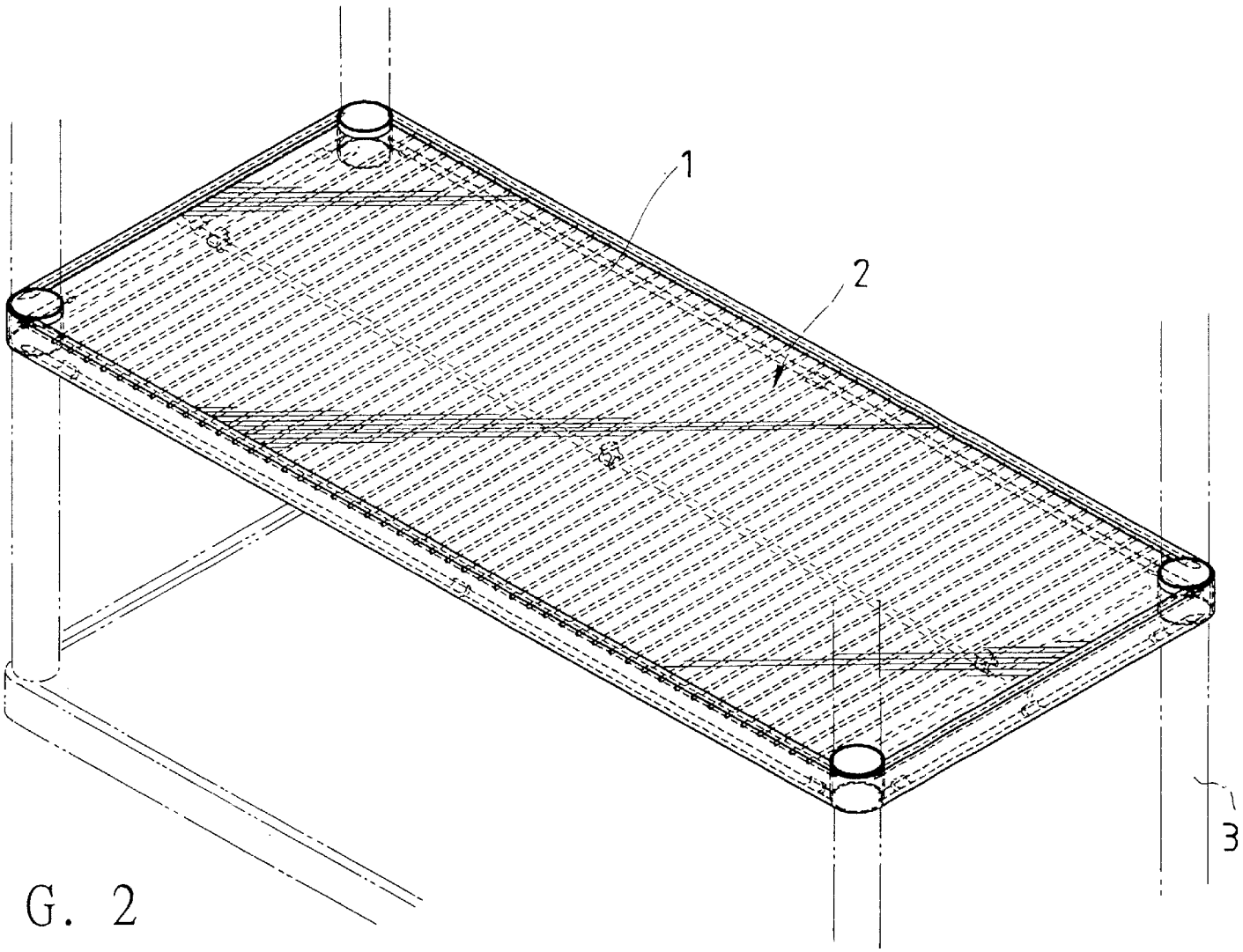
FIG. 2 is a perspective view of the protective cover of the present invention joined to an article support.

The protective cover 1 is fitted over the article support 2 with the clipping elements 15 clipping onto the metal bars 21 of the article support 2, and with the hooking elements 13 hooking onto the lower metal rods 23 of the frame; the through holes 16 are aligned with the connecting tubes 24 of the article support 2 so that legs 3 (FIG. 2) of the article support can be passed through the holes 16 to be connected to the protective cover 1 after having been passed through the connecting tubes 24.

In addition, the engaging portions 14 fit over the upper metal rods 22 of the frame of the article support 2 so that the cover 1 can be joined to the article support 2 with increased firmness.

From the above description, it can be easily seen that the protective cover of the present invention can be securely joined to an article support to provide a stable and flat supporting surface to articles to be placed on the support. And, as can be easily seen in the drawings, the present cover can add to attractiveness of the grille-shaped article support.

What is claimed is:

1. A protective cover for a grille-shaped article support, comprising a flat portion for holding articles thereon; the flat portion having a plurality of clipping elements on a bottom side thereof;

a surrounding wall joined to edges of the flat portion; the surrounding wall having a plurality of hooking elements on an inner side thereof;

the protective cover being configured to be fitted over a grille-shaped article support with the clipping elements being disposed for clipping onto corresponding metal bars of the article support, and the hooking elements being disposed for hooking onto edges of the article support; the flat portion having through holes formed on corners thereof for alignment with connecting tubes disposed on corners of the article support for allowing legs of the article support passing through the connecting tubes to be connected thereto.

2. The protective cover for a grille-shaped article support as claimed in claim 1, wherein engaging portions are formed on the edges of the flat portion for engagement of the edges of the article support.

* * * * *